United States Patent [19]

Price

[11] Patent Number: 4,686,715

[45] Date of Patent: Aug. 18, 1987

[54] PATIENT GOWN

[76] Inventor: Sandra N. Price, 6277 S. Locust St., Englewood, Colo. 80110

[21] Appl. No.: 911,957

[22] Filed: Sep. 26, 1986

[51] Int. Cl.[4] ..... A41D 9/00

[52] U.S. Cl. ..... 2/114

[58] Field of Search ..... 2/114, 74, DIG. 7, 105, 2/114

[56] References Cited

U.S. PATENT DOCUMENTS

| | | | |
|---|---|---|---|
| 646,194 | 3/1900 | Sims | 2/114 |
| 1,233,156 | 7/1917 | Zies | 2/114 |
| 3,276,036 | 10/1966 | Carter | 2/114 |
| 4,570,268 | 2/1986 | Freedman | 2/114 |

*Primary Examiner*—Doris L. Troutman

*Attorney, Agent, or Firm*—Gary M. Polumbus

[57] ABSTRACT

A hospital or patient gown includes two identical segments having front and back panels, a sleeve opening and a neck opening, with the front and back panels of each segment being connected along one side and disconnected along the opposite side. Each segment includes fastening straps adapted to extend across the opposite shoulder from the sleeve of that segment. The segments are placed on opposite sides of the body so that the front and back panels of each segment overlap each other and are each suspended from both shoulders of the patient.

9 Claims, 5 Drawing Figures

PATIENT GOWN

BACKGROUND OF THE INVENTION

1. Field Of The Invention

The present invention relates to gowns worn by medical patients and more particularly to medical patient gowns of the type typically worn in hospitals, medical clinics and the like.

2. Description Of The Prior Art

For convenience in examining patients in a hospital, medical clinic or the like, the patients normally wear what is commonly referred to as a patient or hospital gown which is comfortable on the patient and allows quick and easy access to the various body parts which may be under examination. One drawback with most patient gowns is that they are designed to cover the front of the patient's body but are left open at a connection location on the patient's back where typically a couple of string ties are provided to connect the free ends of the gown.

The connection of the free ends of the gown along the back is typically very loose leaving a large gap between the free ends so as to expose the body along the back which is very undesirable from the patient's viewpoint.

To overcome the problem of a gaping back on the patient gown, some gowns have been designed so that the free ends of the gown overlap in the back and while this is a desirable improvement over the typical patient gown, it still has several undesirable characteristics. Namely, it still needs to be fastened behind the back or at an awkward location behind one's side, and it does not allow convenient access to the front of the patient's body as the gown completely encloses the front of the patient's body. Other patient gowns merely comprise a completely enclosed draping gown with a neck opening or conventional pajama-type gowns having an upper and a lower component part but in both instances, access to the patient's body is inhibited and accordingly, is not as functional from a utilitarian standpoint.

Another prior art patient gown comprises a single-piece garment having three armholes so that the garment can be wrapped around the body and overlap one shoulder so that one of the patient's arms, can extend through the third armhole and thereby retain the gown in place without the use of ties or buttons. The obvious disadvantage in this particular gown is that it has limited access to the body due to the fact that the gown wraps completely around the patient's body and then includes a continuing overlap.

While there have been several attempts to improve on the typical hospital or patient gown of the type previously described, these attempts have fallen short of a gown that is easy to put on, is comfortable to wear and still allows convenient access to the patient's body by the doctor or other attending assistant. It is to overcome the shortcomings in the prior art patient gowns that the present invention has been developed.

SUMMARY OF THE INVENTION

The patient gown of the present invention includes two pair of front and back panels, a pair of arm openings and a neck opening with one pair of front and back panels being connected along one side of the gown, and the other pair of front and back panels being connected along the opposite side of the gown so that the patient's body is fully covered but ready access can be had thereto from the side of the patient at either the front or the back of the gown.

In the preferred embodiment of the invention, the gown is made of two identical segments, each including a front and back panel which are secured together along one side and define a sleeve through which one arm of the patient can extend. The opposite side edge of the front and back panels of each segment are disconnected but each has a fastening means in the form of a strap or the like near the upper edge thereof that can be attached across the shoulder which is on the opposite side of the patient from the sleeve. The segments are placed on the patient's body on opposite sides thereof so that the sleeve opening on one segment accommodates the right arm and the sleeve opening on the other segment accommodates the left arm with the fastening straps extending across the opposite shoulders from the sleeves.

There are obvious advantages to a gown of the type hereinafter described in that the front and back panels of the gown are identical as are the gown segments themselves so that the gown segments are interchangeable from left side to right or front to back alleviating unnecessary sorting problems in supply rooms or the like. Further, as mentioned previously, when the two segments are placed on the patient, the patient's body is completely enclosed within the gown so that portion's of the patient's body are not exposed but ready access can be had thereto by a doctor or other attending assistant from either the front or the back of the gown along the disconnected or free side edges of the front and back panels.

The neck opening for each segment of the gown can also be varied if desired to accommodate tracheotomy patients or the like by cutting a lower neck than may be desirable for other types of patients. Further, various asthetics can be accommodated by utilizing fabrics of different colors, either matching or coordinating, by using different prints on the fabrics, as well as numerous other variations of an asthetic nature.

Other aspects, features and details of the present invention can be more completely understood by reference to the following detailed description of a preferred embodiment, taken in conjunction with the drawings, and from the appended claims.

DESCRIPTION OF THE PREFERRED EMBODIMENT

Figure 1:
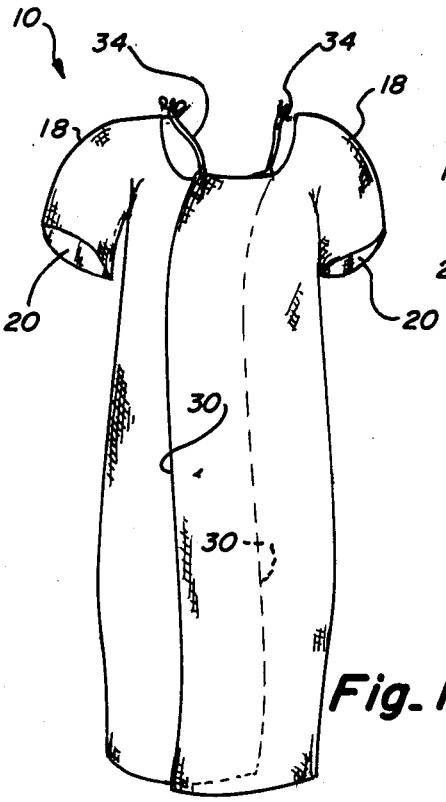
FIG. 1 is a perspective view of the hospital gown of the present invention being worn by an individual shown in dashed lines.
Figure 2:
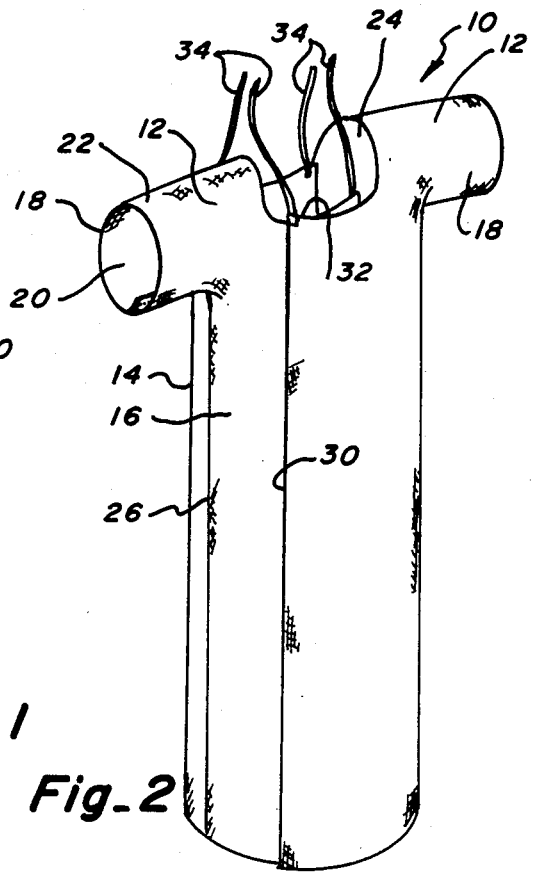
FIG. 2 is a perspective view of the hospital gown of the present invention while not being worn.
Figure 3:
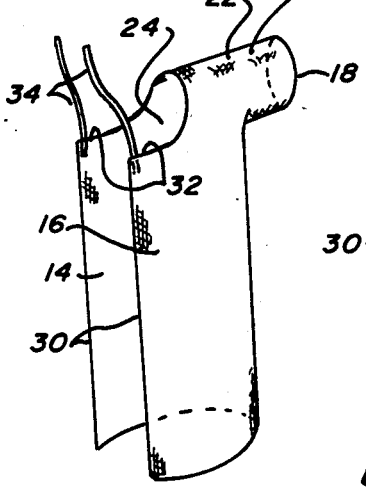
FIG. 3 is a perspective view of one segment of the hospital gown shown in FIG. 2.
Figure 4:
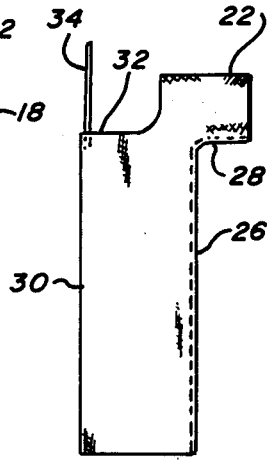
FIG. 4 is a rear elevation of the segment shown in FIG. 3.
Figure 5:
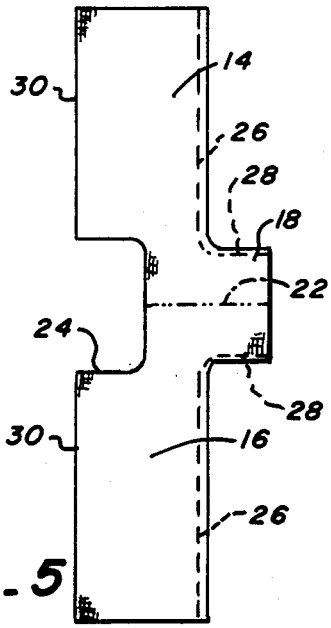
FIG. 5 is a plan view of the fabric piece from which the segment shown in FIG. 4 is formed with a fold line shown in phantom lines and proposed stitching locations shown in dashed lines.

Referring first to FIG. 1, the patient gown 10 of the present invention can be seen on a patient consist of two identical segments 12. The segments 12 as best seen in FIGS. 2 through 5 include a front panel 14 and a rear panel 16 of identical configuration. The panels 14 and 16 are substantially rectangular but have a sleeve 18 defining an arm hole 20 formed as a lateral projection near the upper edge 22. A neck opening 24 is provided in each panel in the form of a cutout provided along the top edge 22 of the panels on the opposite side thereof from the sleeve projection 18.

Since the front and back panels are identical, when the panels are placed in confronting face-to-face relationship, they can be stitched or otherwise secured along the top and underside of the sleeve and along the continuing vertical outside edge 26 of the panels if the panels were made from two separate sheets of material. In the preferred embodiment, however, each segment 12 of the patient gown is made from a single piece of fabric which is folded along the shoulder or the top edge 22 of the sleeve so that the front and back panels form an identical overlay. After the fabric has been folded, the front and back panels can be sewn or otherwise secured together along the underside 28 of the sleeve and along the continuing side edge 26 of the panels leaving the opposite edges 30 of the panels disconnected.

The width of the front and back panels 14 and 16 is substantially the same as the width of the patient's body so that each panel extends approximately halfway around the patient from one side to the other side. The front panel obviously would extend across the front of the patient while the back panel extends across the back of the patient. At the top corner 32 of the disconnected side edges 30 of the front and back panels a fastening means in the form of straps 34 are provided which can be extended across the opposite shoulder of the patient from the sleeve 18 thereby supporting the gown 10 from the opposite shoulder. In this manner, each segment 12 of the gown is supported on both shoulders via the sleeve 18 on one side and the fastening straps 34 on the opposite side. The fastening straps can be in the form of velcro-type fasteners, string ties or any other suitable means for securing the front and back panels across the shoulder.

It will be readily apparent that each segment 12 of the gown 10 is placed on the opposite side of the body so that the sleeve on one segment receives the right arm of the patient while the sleeve on the other segment receives the left arm of the patient thus placing the secured outside edges 26 of the front and back panels of each segment on opposite sides of the body to enclose the entire body within the two segments. On the other hand, it will be appreciated that the front and back panels of one segment will totally overlap the front and back panels respectively of the other segment so that access to the patient's body can be easily had by lifting the front or back panel on the outer segment to gain access to the front and back panels of the inner segment which can also be lifted at the appropriate location on the patient's body. As can be appreciated, the gown is very comfortable to wear, encloses the patient's body from view, yet provides ready access for the physician or other attending assistant.

The gown 10 can be made very quickly and inexpensively as each segment 12 of the gown is identical with the front and rear panels 14 and 16 of each segment also being identical so that they can be cut from a common piece of fabric and very simply sewn together along one outside edge 26 and under the sleeve 18. The fastening straps 34 are also very easily secured to the front and rear panels as by stitching.

From an asthetic standpoint, the segments 12 can be made of any color so as to be color coordinated or color complementing and can further include various design patterns or informational graphics or the like to make the gowns more interesting or eye appealing.

Although the present invention has been described with a certain degree of particularity, it is understood that the present disclosure has been made by way of example, and changes in detail or structure may be made without departing from the spirit of the invention, as defined in the appended claims.

I claim:

1. A two piece gown for use by medical patients comprising in combination:

two disconnected substantially identical segments of fabric with each segment having a front panel, a back panel, an arm hole, a neck opening, and fastener means for extension across the user's shoulder which is on the opposite side from the arm hole and whereby when one segment is put on the user by inserting one arm through the arm hole and attaching the fastener means across the opposite shoulder, and the other segment is put on the user in the same manner but on the opposite side of the body, the front and back panels of one segment will overlap respectively the front and back panels of the other segment.

2. The two piece gown of claim 1 further including a neck cut-out from the front and rear panels to expose the user's neck when the segment is put on the user.

3. The two piece gown of claim 1 wherein said fastening means includes Velcro® type fasteners.

4. The two piece gown of claim 3 wherein said Velcro® type fasteners from part of a pair of straps connected respectively to the front and back panels of each segment.

5. The two piece gown of claim 1 wherein the arm hole is in a sleeve of each segment.

6. The two piece gown of claim 1 wherein the front and back panels, which are of substantially rectangular configuration defining two side edges, and the sleeve of each segment are made from a single piece of fabric which has been folded along the top of the sleeve so that the front and back panels are in face-to-face relationship and sewn along the bottom of the sleeve and along the associated side edge of each of the front and back panels leaving the opposite side edges of the front and back panels disconnected.

7. The two piece gown of claim 6 wherein said fastener means includes a pair of straps which are attached to the disconnected side edges of the front and back panels respectively near the top of the disconnected side edges.

8. A gown for use by medical patients comprising two disconnected pair of front and back panels, two arm openings and a neck opening, one pair of front and back panels being secured together along one side of the gown while being disconnected on the opposite side of the gown and the other pair of front and back panels being connected along said opposite side while being disconnected along said one side.

9. The gown of claim 8 wherein said arm openings comprise sleeves with one sleeve being connected to one pair of front and back panels and the other sleeve being connected to the other pair of front and back panels.

* * * * *